US005596885A

United States Patent [19]

Grenier

[11] Patent Number: 5,596,885

[45] Date of Patent: Jan. 28, 1997

[54] PROCESS AND INSTALLATION FOR THE PRODUCTION OF GASEOUS OXYGEN UNDER PRESSURE

[75] Inventor: Maurice Grenier, Paris, France

[73] Assignee: L'Air Liquide, Societe Anonyme Pour L'Etude et L'Exploitation des Procedes Georges Claude, Paris Cedex, France

[21] Appl. No.: 419,555

[22] Filed: Apr. 10, 1995

[30] Foreign Application Priority Data

Jun. 20, 1994 [FR] France ..... 94 07531

[51] Int. Cl.[6] ..... F25J 3/02

[52] U.S. Cl. ..... 62/646; 62/654; 62/913

[58] Field of Search ..... 62/38, 41, 646, 62/654, 913

[56] References Cited

U.S. PATENT DOCUMENTS 4,303,428 12/1981 Vandenbussche ..... 62/38

5,157,926 10/1992 Guilleminot ..... 62/24

5,437,161 8/1995 Chretien ..... 62/38

FOREIGN PATENT DOCUMENTS 0504029 9/1992 European Pat. Off. .

2688052 9/1993 France .

*Primary Examiner*—Ronald C. Capossela

*Attorney, Agent, or Firm*—Young & Thompson

[57] ABSTRACT

An air separation process of the "pumped" type, in which liquid oxygen is removed from a double distillation column and is pumped to a higher production pressure and then vaporized under that pressure. The incoming air is divided into several streams. A first stream is compressed to the medium pressure, cooled and sent to the double distillation column (7). A second stream is compressed above about 25 bars, but below its condensation pressure during vaporization of the liquid oxygen under pressure, then cooled to an intermediate temperature, at which a portion of the air continues its cooling and is liquified (in 20A), then expanded (in 21A) and sent to the double column, while the rest is work expanded (in 4). Use in large size installations for the production of oxygen.

12 Claims, 3 Drawing Sheets

PROCESS AND INSTALLATION FOR THE PRODUCTION OF GASEOUS OXYGEN UNDER PRESSURE

Figure 1:
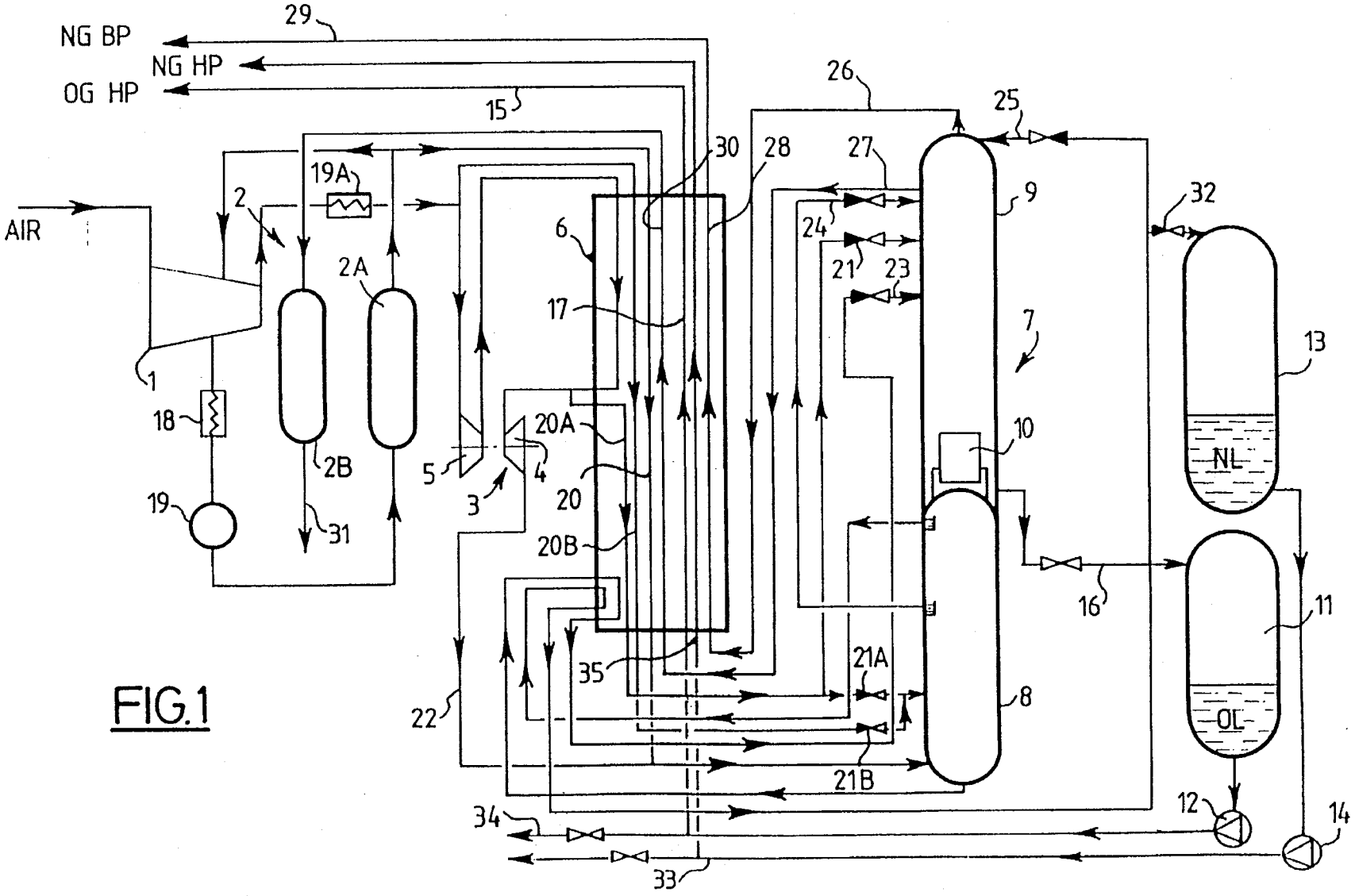

The present invention relates to a process for the production of gaseous oxygen under pressure of the type in which: air is distilled in a double column distillation installation which comprises a medium pressure column operating under a so-called medium pressure, a low pressure column operating under a so-called low pressure, and a heat exchange line to place the air to be distilled in heat exchange relation with the products withdrawn from the double column; liquid oxygen is withdrawn from the low pressure column; this liquid oxygen is brought to an oxygen vaporization pressure of at least about 13 bars, and it is vaporized and reheated under this vaporization pressure, by heat exchange with the air to be distilled undergoing cooling.

In the present text, the indicated pressures are absolute pressures. Moreover, by "condensation" and "vaporization" are meant either a condensation or vaporization as such, or a pseudo condensation or a pseudo vaporization, according to whether the pressures are subcritical or supercritical.

The processes of this type, called "pumped" processes, have the advantage of avoiding or reducing the need for gaseous oxygen compressors, which are costly machines, having serious reliability problems and whose efficiency is generally mediocre.

The invention has for its object to provide a "pumped" process offering wide liberty of regulating the operating parameters and particularly well adapted, from the point of view of specific energy consumption as well as liquid production, to large size installations, which is to say producing at least 700 tons of oxygen per day.

To this end, the invention has for its object a process for the production of gaseous oxygen of the mentioned type, characterized in that:

- a first fraction of the air to be distilled is compressed to a first pressure adjacent the medium pressure, this air is cooled to the vicinity of its dew point in the heat exchange line, and it is sent to the double column;
- a second fraction of the air to be distilled is compressed to a high air pressure, particularly at least equal to about 25 bars, lower than the air condensation pressure by heat exchange with the oxygen in the course of vaporization under said oxygen vaporization pressure, this air is cooled, and partially liquified, and then it is expanded before being introduced into the double column, whilst another portion of the air under the high air pressure is withdrawn from the heat exchange line at an intermediate cooling temperature and is expanded to the medium pressure in an expansion turbine, then is sent to the medium pressure column; and
- at least one liquid product is withdrawn from the installation.

The process according to the invention can comprise one or several of the following characteristics:

- a third fraction of the air to be distilled is compressed to an intermediate pressure between said first and high air pressures, cooled, liquified, expanded and introduced into the double column;
- said second air fraction is brought to an intermediate air pressure, it is only partially cooled, then is supercharged by a cold blower, reintroduced into the heat exchange line, and cooled to said intermediate temperature, at which this air is again withdrawn from the heat exchange line, expanded to the medium pressure in said expansion turbine, which is coupled to the cold blower, and sent to the double column;
- a portion of the third fraction of air is expanded to the medium pressure, after partial cooling, in a second turbine coupled to a blower for supercharging said second air fraction, then is sent to the medium pressure column;
- a portion of the air at the first pressure is withdrawn from the heat exchange line at a third intermediate cooling temperature, and expanded to the low pressure in a blowing turbine before being introduced at an intermediate point in the low pressure column;
- said oxygen vaporization pressure is substantially the production pressure.

The invention also has for its object an installation for the production of gaseous oxygen adapted to practice the process defined above. This installation, of the type comprising: a double air distillation column which comprises a medium pressure column operating under a so-called medium pressure, and a low pressure column operating under a so-called low pressure; a heat exchange line to place the air to be distilled in heat exchange relation with products from the double column; means to withdraw liquid oxygen from the low pressure column; and means to bring this liquid oxygen to an oxygen vaporization pressure of at least about 13 bars, the heat exchange line comprising means to place the liquid oxygen under said vaporization pressure in heat exchange relation with the air to be distilled in the course of cooling, is characterized in that it comprises:

- a first compression means to compress a first fraction of the air to be distilled to a first pressure adjacent the medium pressure, and passages of the heat exchange line connected on the one hand to these first compression means and on the other hand to the double column;
- a second compression means to compress a second fraction of the air to be distilled to a high air pressure, particularly at least equal to about 25 bars, lower than the condensation pressure of the air by heat exchange with the oxygen in the course of vaporization under said vaporization pressure;
- the heat exchange line comprising high pressure air passages to cool said second air fraction to an intermediate temperature and to cool further and to liquify a portion of this second fraction, and the installation comprising expansion means for this liquified portion, connected to the double column;
- an expansion turbine whose intake is connected to the high pressure air passages and whose output is connected to the double column; and
- means to withdraw at least one liquid product from the installation.

The installation can particularly comprise a single air compressor with n stages, said first compression means being constituted by a certain number p of stages, with $p<n$, and said second compression means being constituted by the whole of the compressor.

Figure 2:
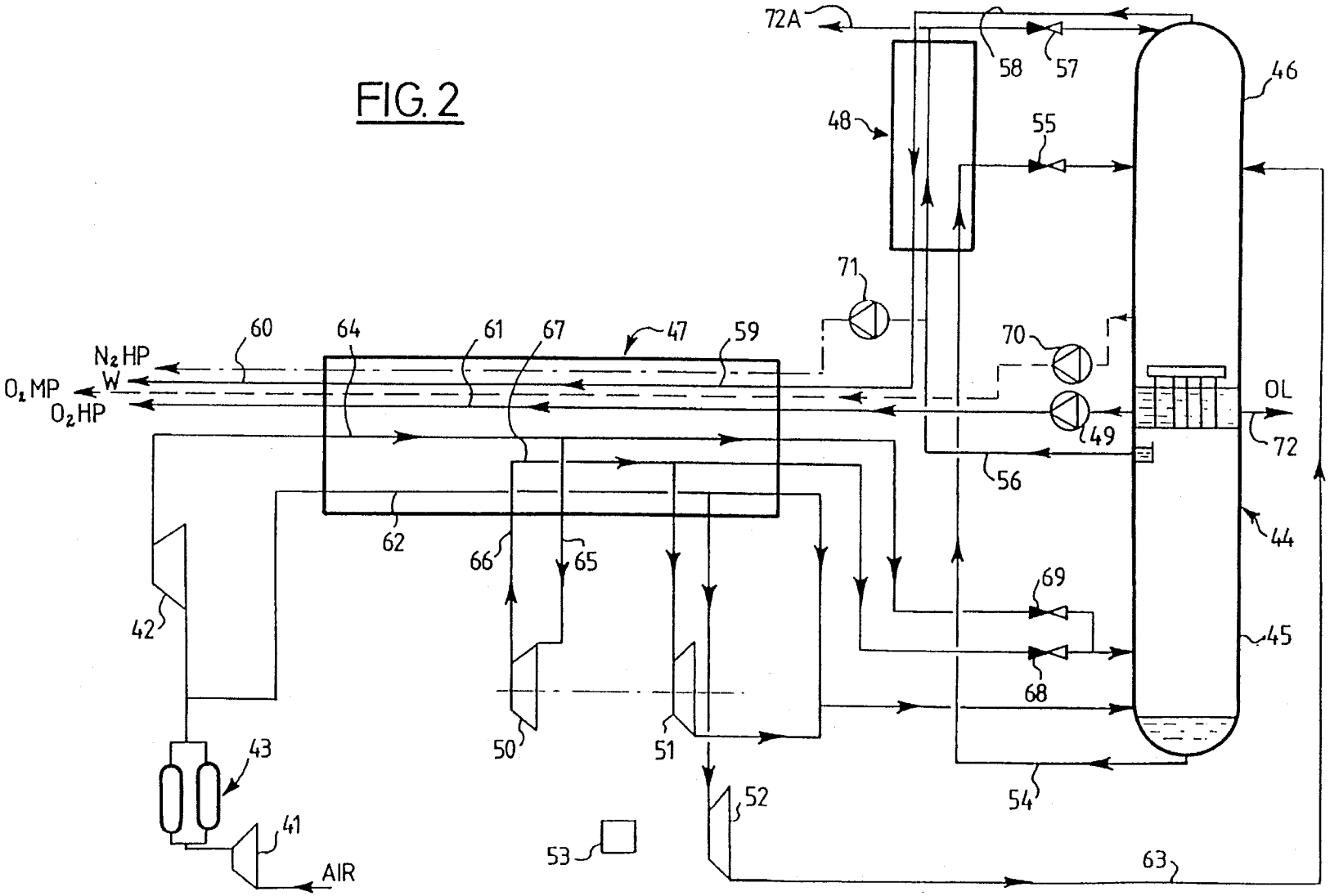
Figure 3:
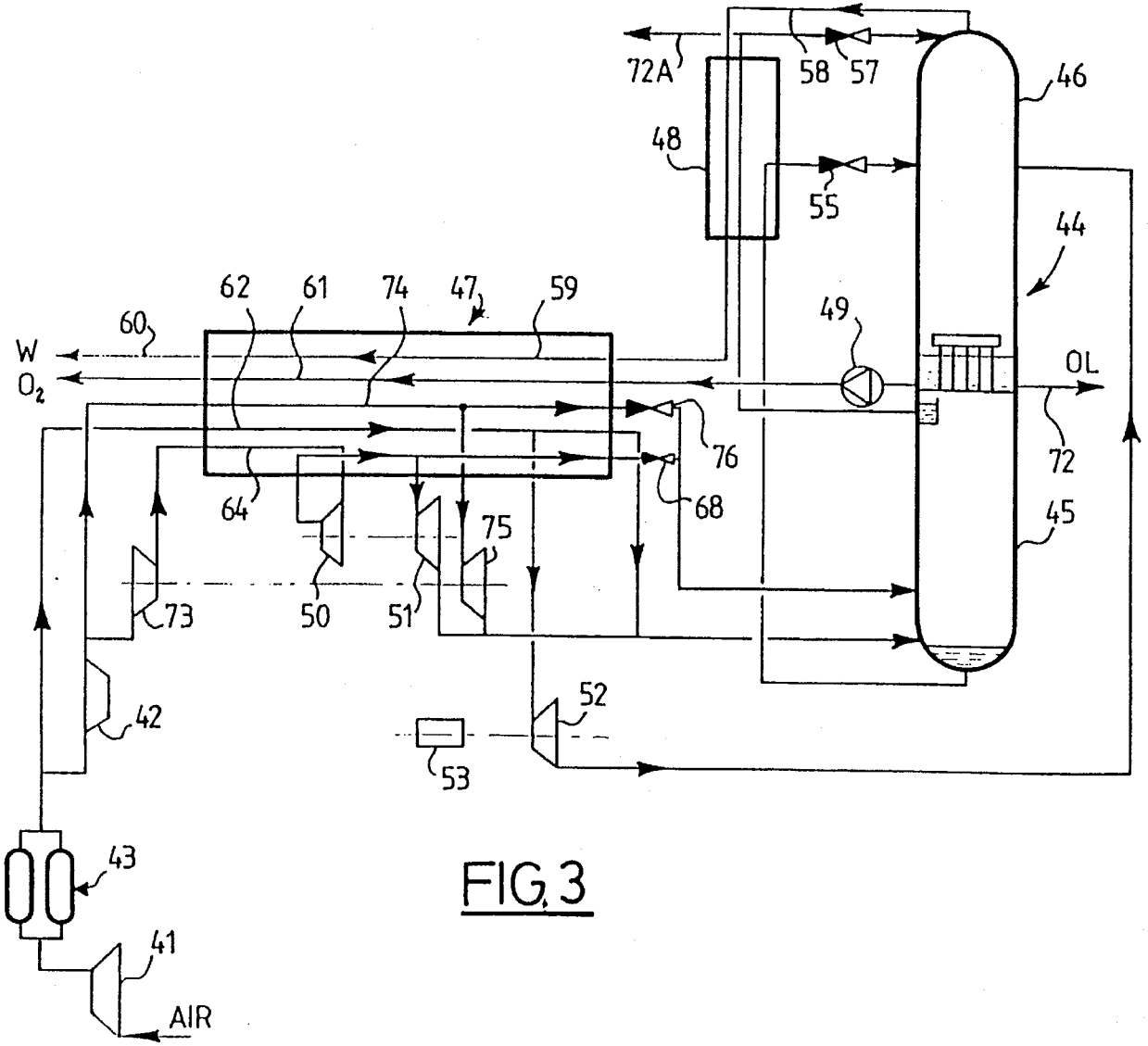

Examples of operation of the invention will now be described with respect to the accompanying drawings, in which FIGS. 1 to 3 show respectively three installations for the production of oxygen according to the invention.

The air distillation installation shown in FIG. 1 comprises essentially: an air compressor 1; an apparatus 2 for the purification of compressed air from water and CO2 by adsorption, this apparatus comprising two adsorption flasks 2A, 2B of which one operates in adsorption while the other is in the course of regeneration; a turbine-blower assembly 3 comprising an expansion turbine 4 and a blower or supercharger 5 whose shafts are coupled, the blower being if desired provided with a cooler (not shown); a heat exchanger 6 constituting the heat exchange line of the installation; a double distillation column 7 comprising a medium pressure column 8 surmounted by a low pressure column 9, with a vaporizer-condenser 10 placing the vapor (nitrogen) at the head of the column 8 in heat exchange relation with the liquid (oxygen) at the base of the column 9; a liquid oxygen reservoir 11 base whose bottom is connected to a liquid oxygen pump 12; and a liquid nitrogen reservoir 13 whose bottom is connected to a liquid nitrogen pump 14.

This installation is principally adapted to supply, via a conduit 15, gaseous oxygen under a high predetermined pressure, which can be comprised between about 13 bars and several tens of bars. Large quantities of oxygen are involved, at least equal to about 700 tons per day and can reach several thousands of tons per day.

To do this, the liquid oxygen withdrawn from the base of the column 9 via a conduit 16 is stored in the reservoir 11. A flow of oxygen, withdrawn from this reservoir, is brought to the high pressure by the pump 12 in liquid phase, then vaporized and reheated under this high pressure in passages 17 of the exchanger 6.

The heat necessary for this vaporization and this reheating, as well as the reheating and if desired the vaporization of other fluids withdrawn from the double column, is supplied by the air to be distilled, under the following conditions.

The compressor 1 is a multistage compressor, with n stages. All the atmospheric air entering is compressed by the p first stages to the medium pressure, which is the operating pressure of the column 8, then is precooled in 18 and cooled to adjacent the ambient temperature in 19, is purified in one, for example 2A, of the adsorption flasks, and divided into two fractions.

The first fraction, under the medium pressure, representing for example about 40% of the flow of the air treated, is cooled, from the warm end to the cold end of the heat exchange line 6, in passages 20 of this latter, to about its dew point, then is directly introduced into the base of the column 8. The rest of the air purified in 2A is returned to the inlet of the (p+1)st stage of the compressor 1 and is compressed by the following stages to a first high air pressure, substantially higher than the medium pressure of the column 8, and in practice higher than 9 bars.

The air thus compressed, precooled in 19A, is again divided into two streams.

The first stream, representing at least 45% of the flow of the air treated, is supercharged to a second high pressure by the supercharger 5, which is driven by the turbine 4. This second high air pressure is comprised between about 25 bars and the condensation pressure of the air by vaporization of the oxygen under the high oxygen pressure.

The first air stream is then introduced into the warm end of the exchanger 6 and cooled in its entirety to an intermediate temperature. At this temperature, a fraction of the air continues its cooling and is liquified in the passages 20A of the exchanger, then is expanded in part to the low pressure in an expansion valve 21 and in part to the medium pressure in an expansion valve 21A and introduced respectively at an intermediate level into the column 9 and into the lower portion of the column 8. The rest of the air is expanded to the medium pressure in the turbine 4 then sent directly, via a conduit 22, to the base of the column 8.

The second stream is introduced under the first high pressure into the heat exchange line 6, cooled and liquified to the cold end of this latter in passages 20B, expanded in an expansion valve 21B and is recombined with the flow from the expansion valve 21A.

There will also be seen in FIG. 1 the usual conduits for double distillation columns, the one illustrated being of the "minaret" type, which is to say with the production of nitrogen under low pressure: the conduits 23 to 25 for injection into the column 9, at progressively higher levels, of expanded "rich liquid" (air enriched in oxygen), of expanded "lower poor liquid" (impure nitrogen) and of expanded "upper poor liquid" (practically pure in nitrogen), respectively, these three fluids being respectively withdrawn from the base, from an intermediate point and from the top of the column 8; and the conduits 26 for withdrawal of gaseous nitrogen from the top of the column 9 and 27 for the withdrawal of residual gas (impure nitrogen) from the injection level of the lower poor liquid. The low pressure nitrogen is reheated in the passages 28 of the exchanger 6, then recovered via a conduit 29, while the residual gas, after reheating in passages 30 of the exchanger, is used to regenerate an adsorption flask, the flask 2B in the example in question, before being discharged via a conduit 31.

It will also be seen in FIG. 1 that a portion of the medium pressure liquid nitrogen is, after expansion in an expansion valve 32, stored in the reservoir 13, and that a production of liquid nitrogen and/or liquid oxygen is supplied via a conduit 33 (for nitrogen) and/or 34 (for oxygen). Moreover, the installation produces, in addition to low pressure gaseous nitrogen drawn directly from the head of column 9 and high pressure oxygen, gaseous nitrogen under pressure, obtained by vaporization in the heat exchange line of a flow of liquid nitrogen from the conduit 33 via a conduit 35. This nitrogen vaporization can particularly be effected by condensation of the air contained in the passages 20A or 20B.

As explained in other patent applications which describe "pumped" processes and "offset phase change isotherms", which is to say in which as in the present invention, the air which provides most of the heat of vaporization fur the oxygen condenses below the vaporization temperature of this oxygen (see for example French patent application Nos. 91-02 917, 91-15 935, 92-02 462, 92-07 662 and 93-04 274), the cold requirements of the installation are balanced, with a temperature difference at the warm end of the heat exchange line of the order of 3° C., by withdrawing from the installation at least one product (oxygen and/or nitrogen) in liquid phase, via the conduits 33 and/or 34.

In the above process, the fact of not compressing a portion of the entering air to more than the medium pressure reduces the quantity of liquid it is necessary to withdraw from the installation. This is very advantageous in the case of large installations, in which the quantities of withdrawn liquid according to the prior art are great. Moreover, the fact of having to withdraw a reduced quantity of liquid is perfectly compatible with the conditions of use of these large installations, which must generally produce also a certain quantity of liquid.

Moreover, calculations show that the process described above has a very advantageous specific energy of oxygen production.

The installation shown in FIG. 2 is adapted to produce gaseous oxygen under high pressure, for example of the order of 40 bars. It comprises essentially two air compressors 41 and 42, an apparatus 43 for purification by adsorption, a double distillation column 44 constituted by a medium pressure column 45, operating under about 6 bars, surmounted by a low pressure column 46, operating under a pressure slightly greater than 1 bar, a heat exchange line 47, a subcooler 48, a liquid oxygen pump 49, a cold blower 50, a first turbine 51 whose rotor is mounted on the same shaft as that of the cold blower, and a second turbine 52 braked by a suitable brake 53 such as an alternator.

There will be seen on the drawing the conventional conduits for a double column, namely: a conduit 54 rising to an intermediate point on the column 46, after subcooling in 48 and expansion to the low pressure in an expansion valve 55, of the "rich liquid" (air enriched in oxygen) collected at the base of the column 45; a conduit 56 rising to the head of the column 46, after subcooling in 48 and expansion to the low pressure in an expansion valve 57, of "poor liquid" (almost pure nitrogen) withdrawn from the head of the column 45; and conduit 58 for withdrawing impure nitrogen, constituting the residual gas W of the installation, this conduit leaving the head of the column 46, passing through the subcooler 48 then connecting to passages 59 for the reheating of nitrogen of the heat exchange line 47. The impure nitrogen thus reheated to ambient temperature is discharged from the installation via a conduit 60.

The pump 49 draws liquid oxygen under about 1 bar from the base of the column 6, brings it to the desired production pressure and introduces it into passages 61 for the vaporization-reheating of oxygen of the heat exchange line.

The air to be distilled, compressed to the medium pressure by a compressor 41 and purified from water and CO2 in 43, is divided into two streams.

The first stream is directly cooled in passages 62 of the heat exchange line 47 to a relatively cold temperature T1 but higher than the temperature at the cold end of this heat exchange line, a fraction of this air is withdrawn from the heat exchange line, expanded to the low pressure in turbine 52, and blown into an intermediate point of the column 46 via a conduit 63. The rest of the medium pressure air continues its cooling to the cold end of the heat exchange line, where it is adjacent its dew point, then is sent to the base of the column 45.

The rest of the air from the apparatus 43 is compressed to a first high pressure, for example 16.5 bars, by the compressor 42, then enters the passages 64 for cooling air in the heat exchange line.

At an intermediate temperature T2 lower than ambient temperature, substantially greater than T1 and adjacent the oxygen vaporization temperature, a portion of this air is withdrawn from the heat exchange line via a conduit 65 and brought to the intake of the cold blower 50. The latter brings this air to the high pressure of 23 bars and, via a conduit 66, the air thus supercharged is returned to the heat exchange line, at a temperature T3 higher than T2, and continues its cooling in supercharged air passages 67 of this latter. A portion of the air carried by the passages 67 is again withdrawn from the heat exchange line at a second intermediate temperature T4 lower than T2 and higher than T1, and expanded to the medium pressure (6 bars) in a turbine 51. The air which leaves this turbine is sent to the base of the column 45. The rest of the air carried by the passages 67 continues its cooling to the cold end of the heat exchange line, being liquified and then subcooled. It is then expanded to the medium pressure in an expansion valve 68 and introduced several plates above the base of the column 45. Similarly, the air carried by the passages 64 which does not leave via the conduit 65 is cooled to the cold end of the heat exchange line, then expanded to the medium pressure in an expansion valve 69 and introduced several plates above the base of the column 45.

As explained in French application FR 92 02 462 mentioned above, the compression of at least a portion of the air under the first high pressure, from intermediate temperature T2, which is adjacent the oxygen vaporization isotherm, to the temperature T3, introduces into the heat exchange line, between these two temperatures, a quantity of heat which substantially compensates the cold excess produced by this vaporization. It will be noted that between T3 and T2, the oxygen exchanges heat with all the air at 16.5 bars and with the air supercharged to 23 bars. There can thus be obtained a heat exchange diagram (enthalpy on the ordinates, temperature on the abscissae) which is very favorable, with a small temperature difference, of the order of 2° to 3° C., at the warm end of the heat exchange line.

The blower 50 which provides this compression is driven by the turbine 51, such that no external energy is necessary. Given the mechanical losses, the quantity of cold produced by this turbine is slightly greater than the heat of compression, and the excess contributes to maintaining the installation cold. The cold balance necessary to maintain this cold is supplied by the turbine 52, or, in a modification, if the oxygen to be produced must have a high purity, by expansion of air or nitrogen to the medium pressure in a turbine, in a conventional manner.

The very good energy efficiency ensured by the use of the cold blower 50 is preserved here, with moreover the advantage, as previously, of a reduced liquid production, even zero in this case, and also with the advantage of simplified supply to the installation turbine 52.

The installation could also produce oxygen under a sufficiently low pressure to permit the vaporization of oxygen by air condensation at the highest air pressure of the process. This oxygen pressure would for example be less than 8 bars. Thus, there is shown in broken line in FIG. 2 a second pump 70 compressing the liquid oxygen of reduced purity to an intermediate pressure lower than 8 bars. This oxygen is vaporized by condensation of a corresponding portion of the air supercharged by the blower 50, which need only supply the heat to compensate the cold excess due to the vaporization of high pressure oxygen.

Similarly, there is indicated in broken line in FIG. 2 a medium pressure liquid nitrogen pump 71 bringing this nitrogen, withdrawn from the column 45, to a sufficiently low intermediate pressure to permit its vaporization by condensation of air at the highest pressure of the process, namely 23 bars.

There is also shown in FIG. 2 a conduit 72 for the production of liquid oxygen withdrawn from the base of the column 46, as well as a conduit 72A for the production of liquid nitrogen from the head of the column 45.

The installation shown in FIG. 3 is a modification of that of FIG. 2. In this modification, a fraction of the air from the compressor 42 is supercharged by a warm blower 73, cooled in 47 to the temperature T2, supercharged again by the cold blower 50, reintroduced into the heat exchange line at a temperature T3 higher than T2, then treated in two separate streams starting from the temperature T4, as before. The rest of the air from the compressor 42 is cooled in additional passages 74 of the heat exchange line 47 to a temperature T5 comprised between temperatures T4 and T1, and, at this temperature, a portion of this air is withdrawn from the heat exchange line, expanded to the medium pressure in an additional turbine 75 coupled to the blower 73, then sent to the base of the column 45. The rest of the air carried by the passages 74 continues its cooling to the cold end of the heat exchange line, where it is liquified and subcooled, then is expanded to the medium pressure in an expansion valve 76 and sent to the lower portion of the column 45. It will be understood that the invention is adaptable to numerous variations of embodiment for the production of gaseous oxygen under pressure of the "pumped" type and "offset phase change isotherms" type, particularly as described in the mentioned patent applications.

The invention is particularly advantageous from an energy point of view when the oxygen vaporization pressure is greater than about 20 bars.

I claim:

1. In a process for the production of gaseous oxygen under pressure, of the type in which: air is distilled in an installation with a double distillation column (7; 44) which comprises a medium pressure column (8; 45) operating under a medium pressure, a low pressure column (9; 46) operating under a low pressure, and a heat exchange line (6; 47) to place the air to be distilled in heat exchange relation with products withdrawn from the double column; liquid oxygen is withdrawn from the low pressure column; the withdrawn liquid oxygen is brought to an oxygen vaporization pressure of at least about 13 bars, and it is vaporized and reheated under said vaporization pressure, by heat exchange with the air to be distilled in the course of cooling; the improvement comprising compressing a first fraction of the air to be distilled to a first pressure adjacent the medium pressure, cooling the compressed first fraction of air to the vicinity of its dew point in the heat exchange line (6; 47), and sending the cooled compressed first fraction of air to the double column (7; 44); compressing a second fraction of the air to be distilled to a high air pressure at least equal to about 25 bars but lower than the condensation pressure of the air by heat exchange with the oxygen in the course of vaporization under said oxygen vaporization pressure, cooling and partially liquefying the compressed second fraction of air, then expanding and introducing the compressed second fraction of air into the double column; withdrawing a portion of air under the high pressure from the heat exchange line (6; 47) at an intermediate cooling temperature, expanding the latter air to the medium pressure in a first expansion turbine (4; 51), then sending the latter expanded air to the double column (7; 44); and withdrawing at least one liquid product (in 33, 34; 72, 72A) from the installation.

2. Process according to claim 1, further comprising compressing a third fraction of the air to be distilled to a pressure intermediate said first and high air pressures, and cooling, liquefying (in 20B; 64; 74), and expanding (in 21B; 69; 76) the last-named air and introducing it into the double column (7; 44).

3. Process according to claim 2, comprising expanding a portion of the third fraction of air to the medium pressure, after partial cooling, in a second turbine (75) coupled to a blower (73) for supercharging said second air fraction, then sending the supercharged air to the medium pressure column (45).

4. Process according to claim 1, further comprising bringing said second air fraction to an intermediate air pressure (in 42; 42, 73), only partially cooling the same, then supercharging the same by a cold blower (in 50), reintroducing the same into the heat exchange line (47), cooling the same to said intermediate temperature, again withdrawing some of the same from the heat exchange line, expanding this latter to the medium pressure in said expansion turbine (51), which is coupled to the cold blower, and sending the same to the double column (44).

5. Process according to claim 4, further comprising withdrawing a portion of the air at the first temperature from the heat exchange line (47) at a third intermediate cooling temperature, expanding the withdrawn air to the low pressure in a blowing turbine (52), and then introducing the expanded air into an intermediate point of the low pressure column (46).

6. Process according to claim 1, wherein said oxygen vaporization pressure is substantially the production pressure.

7. In an installation for the production of gaseous oxygen under pressure, comprising: a double air distillation column (7; 44) which comprises a medium pressure column (8; 45) operating under a medium pressure, and a low pressure column (9; 46) operating under a low pressure; a heat exchange line (6; 47) to place the air to be distilled in heat exchange relation with products from the double column; means to withdraw liquid oxygen from the low pressure column; and means (12; 49) to bring this liquid oxygen to an oxygen vaporization pressure of at least about 13 bars, the heat exchange line comprising means to place the liquid oxygen under said vaporization pressure in heat exchange relation with air to be distilled in the course of cooling; the improvement which comprises:

first compression means (1; 41) to compress a first fraction of air to be distilled to a first pressure adjacent the medium pressure, and passages (20; 62) of the heat exchange line being connected at one end to these first compression means and at another end to the double column (7; 44);

second compression means (1, 5; 41, 42, 50; 41, 42, 73, 50) to compress a second fraction of the air to be distilled to a high air pressure equal to at least about 25 bars but lower than the condensation pressure of the air by heat exchange with the oxygen in the course of vaporization under said vaporization pressure;

the heat exchange line comprising high pressure air passages (20A; 64) to cool said second air fraction to an intermediate temperature and to further cool and liquify a portion of this second fraction, and the installation comprising means (21A; 68, 69) for expansion of this liquified portion, connected to the double column;

a first expansion turbine (4; 75) whose intake is connected to the high pressure air passages (74) and whose output is connected to the double column (7; 74); and means (72, 72A) to withdraw at least one liquid product from the installation.

8. Installation according to claim 7, which further comprises means (1; 1, 42) to compress a third fraction of the air to be distilled to a pressure intermediate said first and high air pressures, the heat exchange line (6; 47) comprising passages (20B; 64; 74) for cooling and liquefaction of this third fraction, and a conduit connecting the cold end of these passages to the double column (7; 44) and provided with an expansion valve (21B; 69; 76).

9. Installation according to claim 8, wherein the second compression means comprises a blower (73) for supercharging said second air fraction, coupled to a second turbine (75) for expansion of a portion of said third air fraction.

10. Installation according to claim 7 which further comprises a single air compressor (1) with n stages, said first compression means being constituted by a certain number p of stages, with $p<n$, and said second compression means being constituted by the whole of the compressor.

11. Installation according to claim 7, wherein the second compression means (42, 50) comprise a compressor whose output is connected to the warm end of the heat exchange line (47), and a blower (50) whose intake and outlet are connected to intermediate points of this latter.

12. Installation according to claim 7, wherein the second compression means comprises a cold blower (50) coupled to said first turbine (51), and a blowing turbine (52) supplied by a portion of the air under the first pressure and whose output is connected to the low pressure column (46).

* * * * *